US012629737B2

(12) United States Patent
Matsui et al.

(10) Patent No.: US 12,629,737 B2
(45) Date of Patent: May 19, 2026

(54) ROLLING MILL FACILITY

(71) Applicant: PRIMETALS TECHNOLOGIES JAPAN, LTD., Hiroshima (JP)

(72) Inventors: Yoichi Matsui, Hiroshima (JP); Yuta Odawara, Hiroshima (JP)

(73) Assignee: PRIMETALS TECHNOLOGIES JAPAN, LTD., Tokyo (JP)

( * ) Notice: Subject to any disclaimer, the term of this patent is extended or adjusted under 35 U.S.C. 154(b) by 371 days.

(21) Appl. No.: 18/038,626

(22) PCT Filed: Dec. 17, 2020

(86) PCT No.: PCT/JP2020/047228

§ 371 (c)(1),
(2) Date: May 24, 2023

(87) PCT Pub. No.: WO2022/130582

PCT Pub. Date: Jun. 23, 2022

(65) Prior Publication Data

US 2024/0009723 A1 Jan. 11, 2024

(51) Int. Cl.

| | |
|---|---|
| ***B21B 38/04*** | (2006.01) |
| ***B21B 1/22*** | (2006.01) |
| ***B21B 13/02*** | (2006.01) |
| ***B21B 37/44*** | (2006.01) |
| ***B21B 45/00*** | (2006.01) |
| ***B21C 51/00*** | (2006.01) |

(52) U.S. Cl.

CPC ..... *B21B 38/04* (2013.01); *B21B 1/22* (2013.01); *B21B 13/02* (2013.01); *B21B 37/44* (2013.01); *B21B 45/004* (2013.01); *B21C 51/00* (2013.01); *B21B 2013/025* (2013.01)

(58) Field of Classification Search

CPC ..... B21B 38/04; B21B 37/44; B21B 45/004; B21C 51/00

See application file for complete search history.

(56) References Cited

U.S. PATENT DOCUMENTS

| | | | | |
|---|---|---|---|---|
| 6,427,507 | B1 | 8/2002 | Hong et al. | |
| 6,678,634 | B1 * | 1/2004 | Wendt | B21B 38/04 702/170 |
| 2007/0280415 | A1 * | 12/2007 | Waterson | G01B 15/08 378/55 |
| 2016/0339493 | A1 | 11/2016 | Ueno et al. | |

FOREIGN PATENT DOCUMENTS

| | | | |
|---|---|---|---|
| JP | 4131843 | B2 | 8/2008 |
| JP | 2014-21099 | A | 2/2014 |
| JP | 2015-139810 | A | 8/2015 |
| KR | 10-2001-0075012 | A | 8/2001 |

OTHER PUBLICATIONS

Korean Office Action for Korean Application No. 10-2023-7003916, dated May 8, 2025, with English translation.

* cited by examiner

*Primary Examiner* — Debra M Sullivan

(74) *Attorney, Agent, or Firm* — Birch, Stewart, Kolasch & Birch, LLP

(57) ABSTRACT

A rolling mill facility includes: a support part extending along a plate width direction of a steel plate to be rolled; a thickness measurement part supported by the support part and configured to measure a thickness of the steel plate; and a heating part supported by the support part at positions at both sides across the thickness measurement part in the plate width direction and configured to heat both edge portions of the steel plate.

12 Claims, 7 Drawing Sheets

ROLLING MILL FACILITY

TECHNICAL FIELD

The present disclosure relates to a rolling mill facility.

BACKGROUND ART

In a rolling mill facility for rolling a steel plate, various devices are used in addition to a rolling mill including a mill roll in order to obtain a product having a desired shape and desired quality. Examples of such a device include a device for measuring the thickness of a steel plate, and a device for heating an edge portion of a steel plate in the plate width direction to suppress an edge crack at the plate edge, for instance.

Patent Document 1 discloses a device disposed on the production line for rolled steel plates, for measuring the thickness profile in the plate width direction of the steel plate. The device includes an X-ray generator which emits X-ray along the thickness direction of the steel plate toward the steel plate and a detector disposed at an opposite side to the X-ray generator across the steel plate, and is configured to measure the thickness profile of the steel plate on the basis of the attenuation amount of X-ray detected by the detector.

Patent Document 2 discloses a heating device disposed on the production line for rolled steel plates, for heating the opposite edge portions in the plate width direction. The heating device includes a pair of inductors disposed so as to sandwich the opposite edge portions in the plate width direction of the steel plate without contact from the opposite sides in the plate width direction, and is configured to inductively heat the opposite edge portions of the steel plate by applying an electric current to the coils of the inductors.

CITATION LIST

Patent Literature

Patent Document 1: JP2014-21099A
Patent Document 2: JP2015-139810A

SUMMARY

Problems to be Solved

Meanwhile, in a case where both of the function to measure the thickness of the steel plate and the function to heat the plate edge portions are to be realized for a rolling mill facility, providing both of a thickness measurement device and a heating device for the plate edge portions leads to an increase in the installation space. In a case where a device that uses electromagnetic wave as a heating device is employed, it is necessary to ensure a distance between the heating device and the thickness measurement device in order to avoid influence of the electromagnetic wave, which may lead to an increase in the installation space. Furthermore, the space in the vicinity of the rolling mill is limited, and thus it is difficult to install both of the thickness measurement device and the heating device for the plate edge portions in the vicinity of the rolling mill. In this regard, Patent Document 1 and Patent Document 2 consider installing only one of the thickness measurement device or the heating device for the plate edge portions, and does not consider installing both devices for a rolling mill facility.

In view of the above, an object of at least one embodiment of the present invention is to provide a rolling mill facility capable of realizing both of the function to measure the thickness of the steel plate and the function to heat the plate edge portions in a limited space.

Solution to the Problems

According to at least one embodiment of the present invention, a rolling mill facility includes: a support part extending along a plate width direction of a steel plate to be rolled; a thickness measurement part supported by the support part and configured to measure a thickness of the steel plate; and a heating part supported by the support part at positions at both sides across the thickness measurement part in the plate width direction and configured to heat both edge portions of the steel plate.

Advantageous Effects

According to at least one embodiment of the present invention, it is possible to provide a rolling mill facility capable of realizing both of the function to measure the thickness of the steel plate and the function to heat the plate edge portions in a limited space.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

Figure 1:
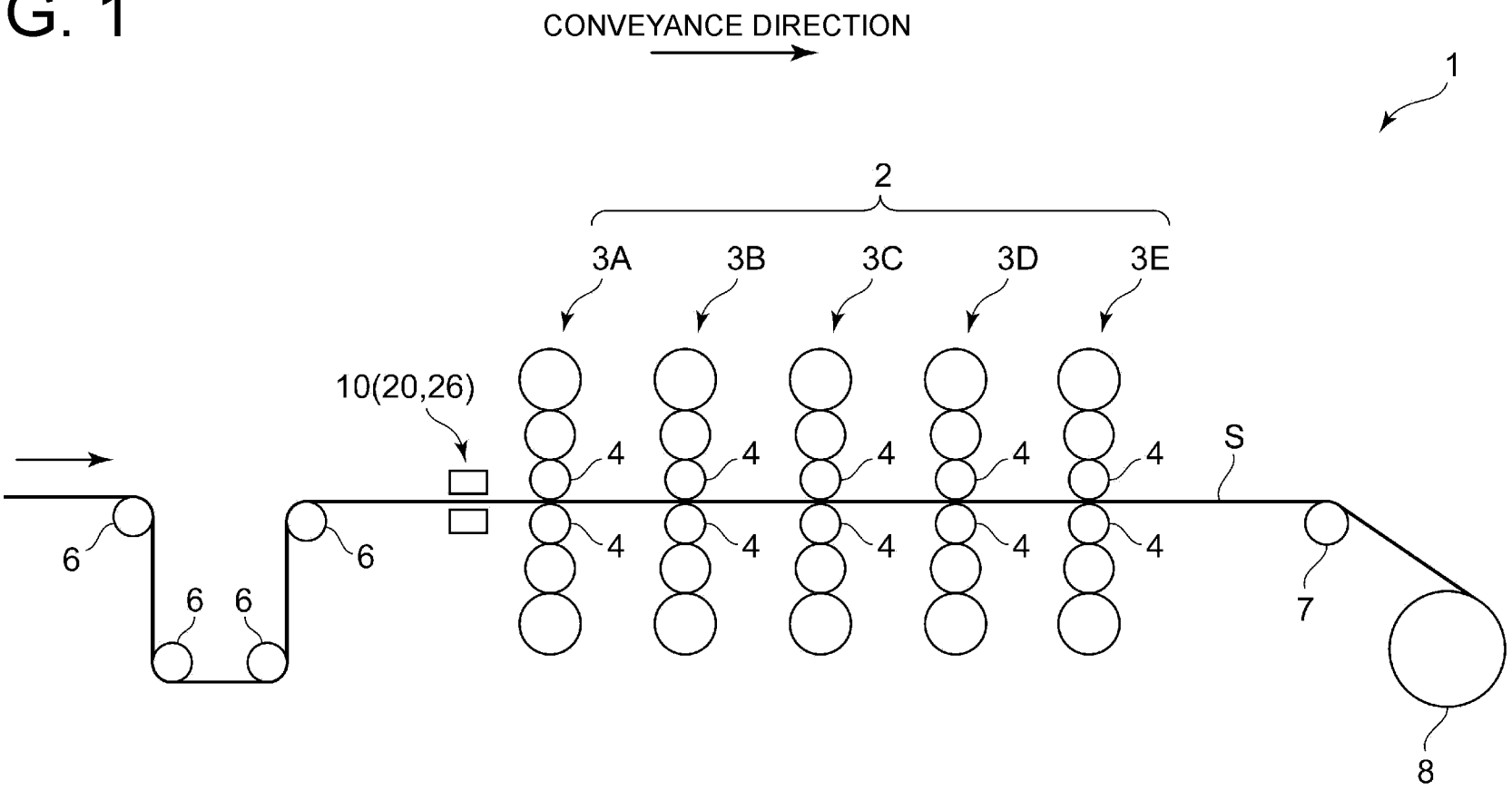
FIG. 1 is a schematic configuration diagram of a rolling mill facility according to an embodiment.

FIG. 1 is a schematic configuration diagram of a rolling mill facility according to an embodiment. As depicted in the drawing, the rolling mill facility 1 includes a rolling mill 2 for rolling a steel plate S, and a thickness measurement/heating device 10 disposed at the upstream side of the rolling mill 2 in the conveyance direction of the steel plate S. Furthermore, the rolling mill facility 1 includes an unwinder (not depicted) for unwinding the steel plate S toward the rolling mill 2, and a rewinder 8 for rewinding the steel plate S after being rolled by the rolling mill 2. In the rolling mill facility 1 depicted in FIG. 1, a conveyance roll 6 for conveying the steel plate S is disposed between the unwinder and the rolling mill 2 in the conveyance direction of the steel plate S. A deflector roll 7 for guiding the steel plate S traveling toward the rewinder 8 is disposed between the rolling mill 2 and the rewinder 8 in the conveyance direction of the steel plate S.

The rolling mill 2 includes at least one rolling mill stand 3 (3A to 3E) each including a pair of mill rolls 4 disposed so as to sandwich the steel plate S from both surface sides. The rolling mill 2 depicted in FIG. 1 includes five rolling mill stands 3A to 3E arranged in the conveyance direction of the steel plate S. The steel plate S unwound from the unwinder is rolled by the rolling mill stands 3A to 3E sequentially, while being conveyed by the conveyance roll 6. The steel plate S after passing through the rolling mill stands 3A to 3E is rewound by the rewinder 8.

The thickness measurement/heating device 10 includes a thickness measurement part 20 for measuring the thickness of the steel plate S and a heating part 26 for heating the opposite edge portions (portions including the opposite edges of the steel plate S in the plate width direction respectively) in the plate width direction of the steel plate S.

The thickness measurement part 20 may be configured to measure the thickness of the center portion of the steel plate S in the plate width direction, or the thickness of the steel plate S at a position corresponding to the center portion in the axial direction of the mill roll 4.

The signal indicating the thickness of the steel plate S measured by the thickness measurement part 20 is sent to a control device (not depicted), and it is possible to control the rolling mill 2 (e.g., control the gap between the mill rolls, for instance) on the basis of the signal. Furthermore, by heating the opposite edge portions in the plate width direction of the steel plate S with the heating part 26, it is possible to suppress an edge crack that occurs at the rolling mill 2.

In some embodiments, the thickness measurement/heating device 10 is disposed in the vicinity of the rolling mill 2 at the upstream side of the rolling mill 2 in the conveyance direction of the steel plate S. In this case, the distance between the thickness measurement/heating device 10 and the rolling mill 2 is short, and thus it is possible to perform rolling before the temperature of the opposite edge portions of the steel plate S heated by the heating part 26 decreases considerably. Thus, it is possible to suppress an edge crack of the steel plate S effectively. In an embodiment, the thickness measurement/heating device 10 is positioned at the downstream side of the conveyance roll 6 positioned most downstream of the plurality of conveyance rolls 6 in the conveyance direction of the steel plate S. That is, in this case, in the conveyance direction, there is no conveyance roll provided between the thickness measurement/heating device 10 and the rolling mill 2.

Next, the thickness measurement/heating device 10 will be described more specifically.

Figure 2:
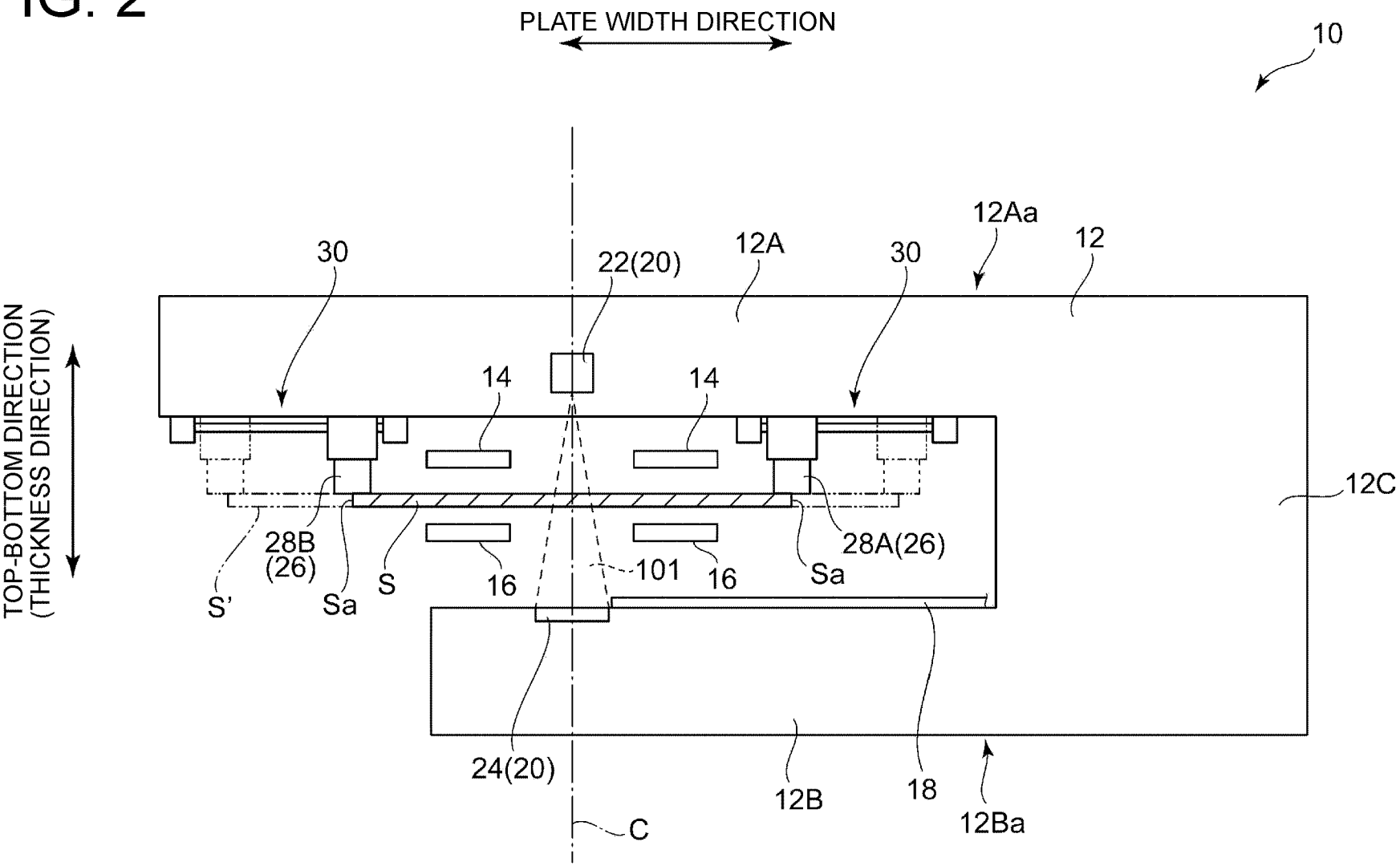
FIG. 2 is a schematic configuration diagram of a thickness measurement/heating device (rolling mill facility) according to an embodiment.
Figure 3:
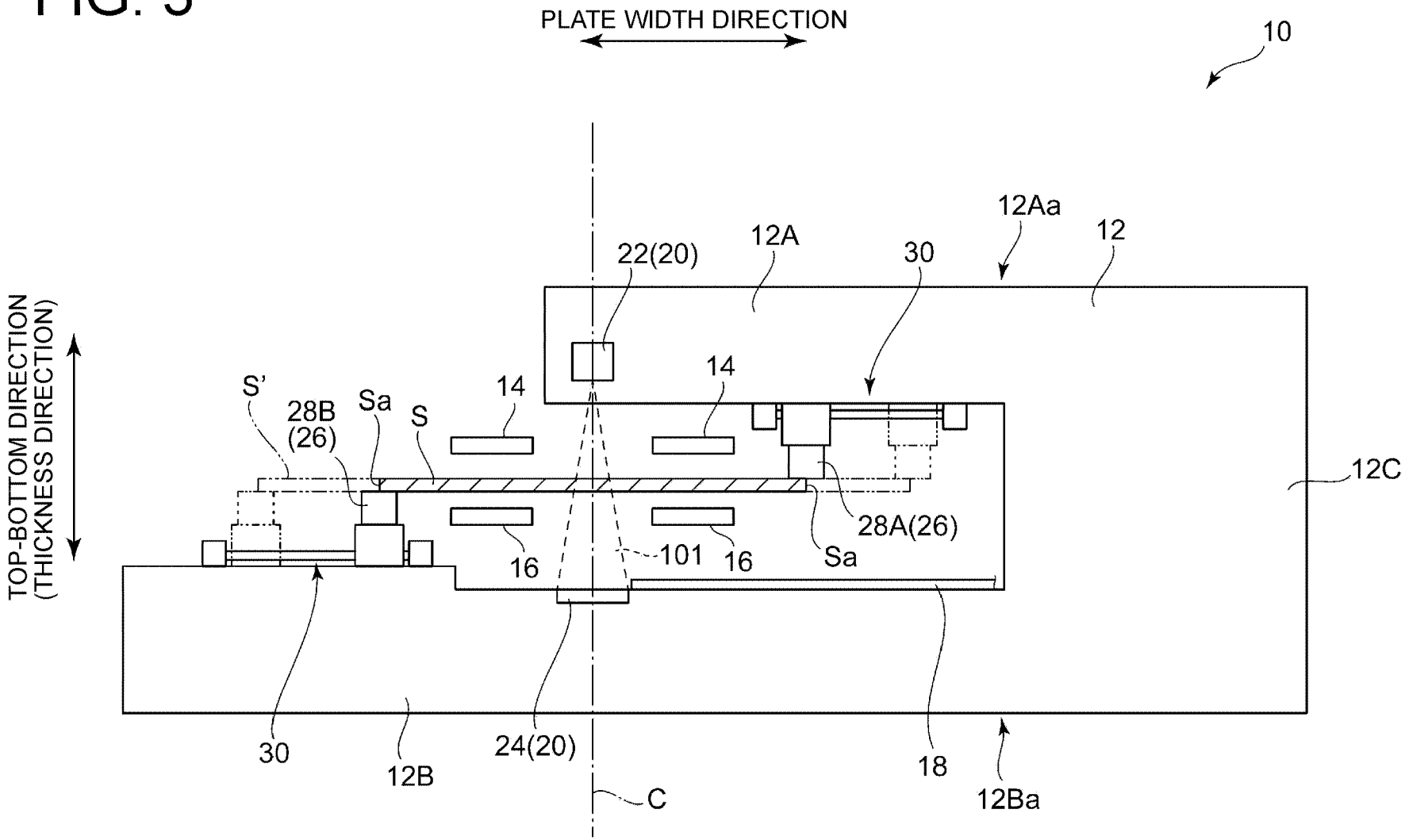
FIG. 3 is a schematic configuration diagram of a thickness measurement/heating device (rolling mill facility) according to an embodiment.

FIGS. 2 and 3 are each a schematic configuration diagram of the thickness measurement/heating device 10 according to an embodiment. As depicted in FIGS. 2 and 3, the thickness measurement/heating device 10 includes a support part 12 extending along the plate width direction of the steel plate S (hereinafter, also referred to as merely the plate width direction), the above described thickness measurement part 20 supported on the support part 12, and the above described heating part 26 supported on the support part 12 at positions at the opposite sides across the thickness measurement part 20 in the plate width direction. In the illustrative embodiment depicted in FIGS. 2 and 3, the heating part 26 is supported on the support part 12 via the first position adjustment part 30 described below.

In the above described embodiment, the thickness measurement part 20 and the heating part 26 are arranged along the plate width direction and supported on the single support part 12 extending along the plate width direction, and thus it is possible to obtain a compact device (the thickness measurement/heating device 10) having both of the thickness measurement function and the plate edge heating function. Thus, it is possible to realize both of the function to measure the thickness of the steel plate S and the function to heat the plate edge portions, in a limited space in the vicinity of the rolling mill 2.

In the illustrative embodiment depicted in FIGS. 2 and 3, the support part 12 includes an upper frame 12A and a lower frame 12B each extending along the plate width direction of the steel plate S above and below the steel plate S, and a side frame 12C extending along the top-bottom direction and connecting the upper frame 12A and the lower frame 12B. The upper frame 12A and the lower frame 12B are disposed so as to face one another across the steel plate S. The side frame 12C is disposed so as to connect an end portion 12Aa of the upper frame 12A and an end portion 12Ba of the lower frame 12B.

In the present specification, the "top-bottom direction" refers to the vertical direction, and "above" and "below" refer to the upper side and the lower side of the vertical direction, respectively. The top-bottom direction (vertical direction) substantially coincides with the thickness direction of the steel plate S to be rolled.

In some embodiments, the thickness measurement part 20 and the heating part 26 are each supported on at least one of the upper frame 12A or the lower frame 12B.

In the above described embodiment, it is possible to appropriately support the thickness measurement part and the heating part with a compact support part including the upper frame and the lower frame extending along the plate width direction, and the side frame connecting the upper frame and the lower frame. Thus, it is possible to obtain a compact device including both of the thickness measuring function and the plate edge heating function.

In some embodiments, the thickness measurement part 20 is configured to measure the thickness of the steel plate S using radiation (e.g., X-ray). In some embodiments, as depicted in FIGS. 2 and 3 for instance, the thickness measurement part 20 includes a radiation generation part 22 and a radiation receiving part 24 disposed at opposite sides across the steel plate S in the thickness direction (or the top-bottom direction) of the steel plate S. The radiation generation part 22 is configured to generate radiation 101 which radiates towards the radiation receiving part 24. The radiation receiving part 24 is configured to receive the radiation 101 generated by the radiation generation part 22 after the radiation 101 penetrates the steel plate S. The thickness measurement part 20 is configured to measure the thickness of the steel plate S on the basis of the attenuation amount of the radiation 101 detected by the radiation receiving part 24.

The radiation receiving part 24 is supported on one of the upper frame 12A or the lower frame 12B. The radiation generation part 22 is supported on the other one of the upper frame 12A or the lower frame 12B. In the illustrative embodiment depicted in FIGS. 2 and 3, the radiation generation part 22 is supported on the upper frame 12A, and the radiation receiving part 24 is supported on the lower frame 12B.

The vicinity of the rolling mill 2 including the mill rolls 4 is often a harsh environment where the rolling mill oil and fume scatter in large quantity, the mill rolls vibrate, and it is dark, for instance. In this regard, according to the above embodiment, the thickness measurement part 20 including the radiation generation part 22 and the radiation receiving part 24 and using radiation is used, which makes it possible to appropriately measure the thickness of the steel plate S in the vicinity of the rolling mill 2 under a harsh environment.

In FIGS. 2 and 3, the center position C of the thickness measurement part 20 (the radiation generation part 22 and the radiation receiving part 24) in the plate width direction is shown in dashed lines. During operation of the rolling mill facility 1, the center position C of the thickness measurement part 20 and the center position of the steel plate S in the plate width direction are substantially the same.

The thickness measurement/heating device 10 may include a protector for protecting the thickness measurement part 20 from the steel plate S in a case where the steel plate S moves up and down unexpectedly, for instance. The thickness measurement/heating device 10 depicted in FIGS. 2 and 3 includes, as the above described protector, a protector 14 disposed between the steel plate S and the radiation generation part 22 (thickness measurement part 20) in the top-bottom direction, and a protector 16 disposed between the steel plate S and the radiation receiving part 24 (thickness measurement part) in the top-bottom direction. The protector 14 and the protector 16 may be supported on the upper frame 12A and the lower frame 12B, respectively. The protector 16 disposed below the steel plate S may have a function to guide the steel plate S being conveyed.

Furthermore, the thickness measurement/heating device 10 may include a cleaner for suppressing or preventing accumulation or adhesion of foreign substances (e.g., metal scales produced from rolling of the steel plate S) to the thickness measurement part 20. The thickness measurement/heating device 10 depicted in FIGS. 2 and 3 includes a gas injection pipe 18 configured to inject gas (air or the like) toward the radiation receiving part 24 as the above described cleaner. By injecting gas toward the radiation receiving part 24 through the gas injection pipe 18, it is possible to suppress accumulation or adhesion of foreign substances to the radiation receiving part 24. Accordingly, it is possible to suppress deterioration of the measurement accuracy or erroneous detection of the thickness measurement part 20.

As depicted in FIGS. 2 and 3, the gas injection pipe 18 (cleaner) may be supported on the frame (the lower frame 12B in FIGS. 2 and 3) supporting the radiation receiving part 24 (thickness measurement part 20) at a position closer to the side frame 12C than the radiation receiving part 24 (thickness measurement part 20) in the plate width direction.

In some embodiments, the heating part 26 includes a pair of heaters 28 (28A, 28B) disposed at opposite sides of the thickness measurement part 20 in the plate width direction. In the illustrative embodiment depicted in FIGS. 2 and 3, a pair of heaters 28 include the first heater 28A disposed at a position closer to the side frame 12C than the thickness measurement part 20 in the plate width direction, and a second heater 28B disposed at an opposite side to the side frame 12C across the thickness measurement part 20 in the plate width direction.

In some embodiments, as depicted in FIGS. 2, and 3 for instance, the heating part 26 includes a heater 28 supported on the upper frame 12A. In the illustrative embodiment depicted in FIG. 2, the first heater 28A and the second heater 28B are each supported on the upper frame 12A. In the illustrative embodiment depicted in FIG. 3, the first heater 28A is supported on the upper frame 12A.

In the above described embodiment, the heater 28 constituting the heating part 26 is supported on the upper frame 12A, and thus it is possible to provide the heating part 26 so as not to interfere with a member arranged below the steel plate S (e.g., the above described gas injection pipe 18 (cleaner) or the like).

In some embodiments, as depicted in FIG. 3 for instance, the heating part 26 includes the heater 28 disposed at an opposite side to the side frame 12C across the thickness measurement part 20 in the plate width direction and supported on the lower frame 12B. In the illustrative embodiment depicted in FIG. 3, the second heater 28B is disposed at an opposite side to the side frame 12C across the thickness measurement part 20 in the plate width direction and supported on the lower frame 12B.

If, hypothetically, the heating part 26 (the heater 28 or the like) is provided and supported on the upper frame 12A in a region opposite to the side frame 12C across the thickness measurement part 20 in the plate width direction, the distance from the side frame 12C to the heating part 26 extends, and the tip load of the upper frame 12A increases. Thus, it is necessary to increase the strength of the support part 12 by increasing the size of the support part 12, for instance. In this regard, in the above described embodiment, the second heater 28B (heating part 26) disposed at an opposite side to the side frame 12C across the thickness measurement part 20 in the plate width direction is supported on the lower frame 12B, and thus the tip load of the upper frame 12A does not increase. Thus, it is less necessary to increase the strength of the support part 12, which makes it possible to obtain a more compact device.

The heating part 26 may be configured to heat the steel plate S by induction heating. That is, the heater 28 (28A, 28B) may be an induction heating device.

In this case, it is possible to heat the steel plate S rapidly and efficiently by induction heating. Thus, even with a small heating device, it is possible to heat the opposite edge portions (portions including the plate edge Sa of the steel plate S in the plate width direction) of the steel plate S being conveyed at a high speed.

In some embodiments, the heating part 26 is configured to be capable of moving along the plate width direction with respect to the support part 12. In the illustrative embodiment depicted in FIGS. 2 and 3, the heater 28 (heating part 26) is supported on the support part 12 so as to be movable in the plate width direction via the first position adjustment part 30. In FIGS. 2 and 3, two types of steel plates having different plate widths are shown in solid lines (steel plate S) and dashed lines (steel plate S'), and the positions of the corresponding heaters 28 (heating parts 26) are shown in solid lines and dashed lines, respectively.

Figure 4A:
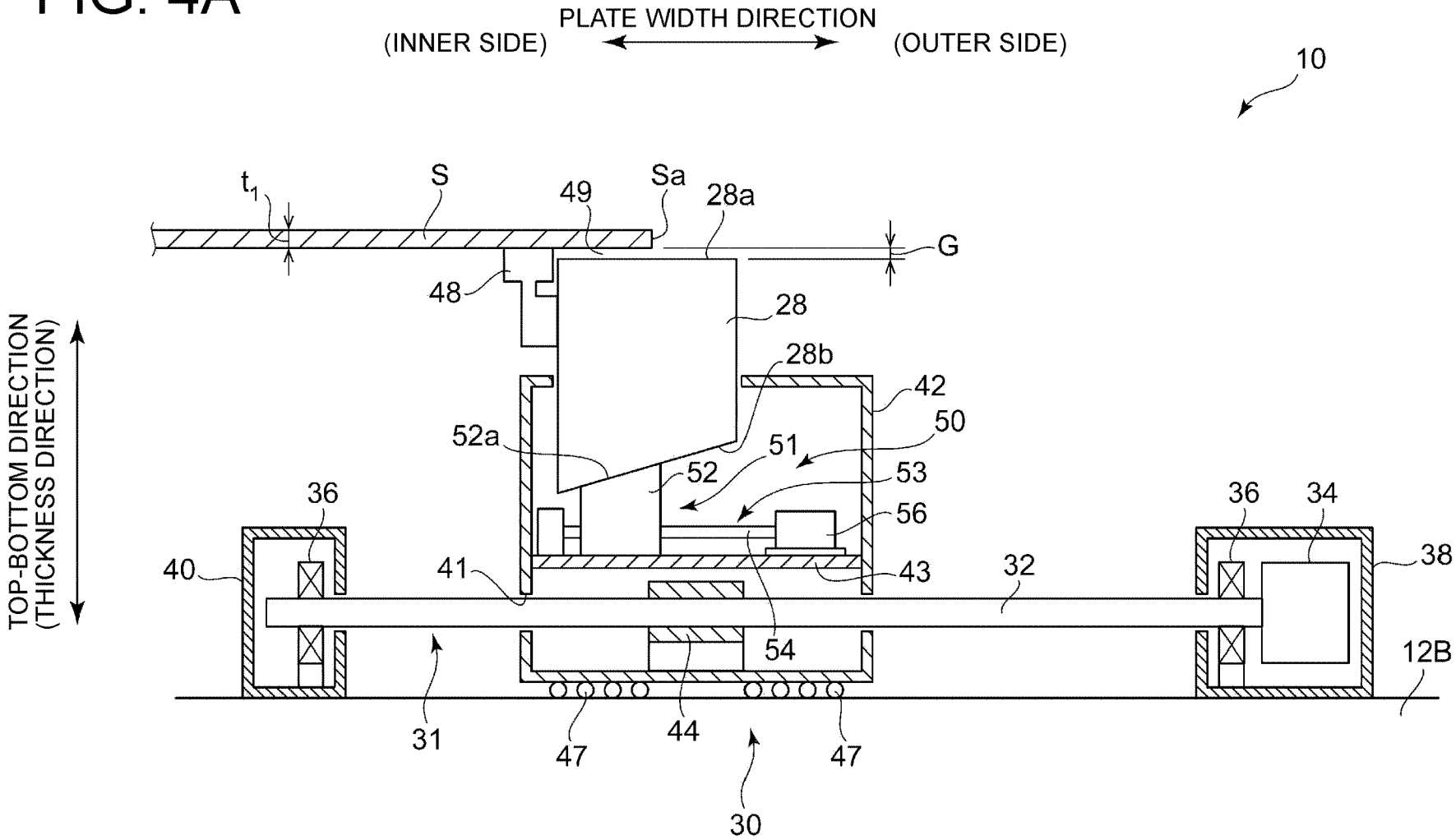
FIG. 4A is an enlarged schematic diagram of a portion including a heating part of a thickness measurement/heating device (rolling mill facility) according to an embodiment.
Figure 4B:
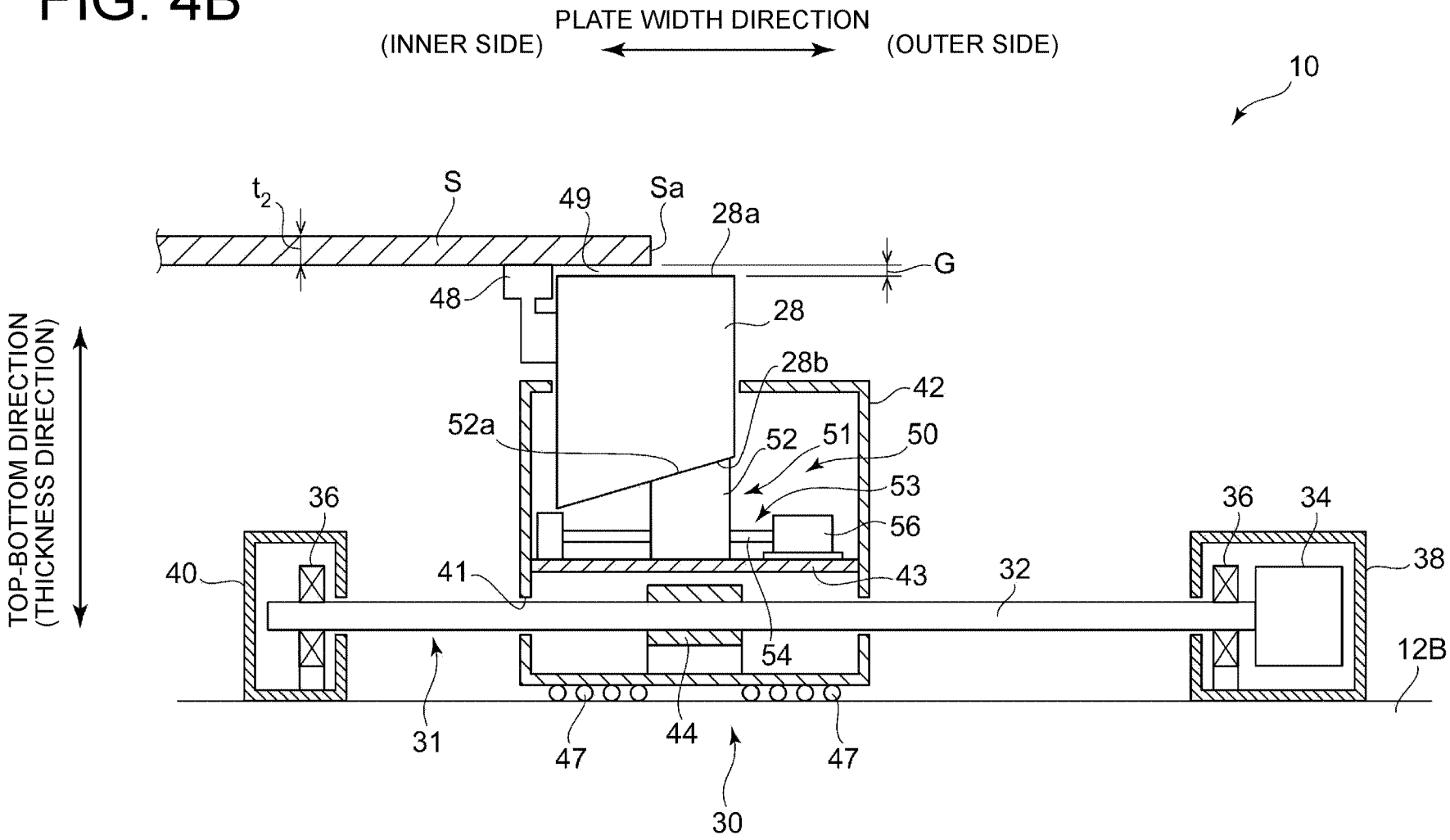
FIG. 4B is a diagram for describing the operation of the thickness measurement/heating device (rolling mill facility) depicted in FIG. 4A.
Figure 5:
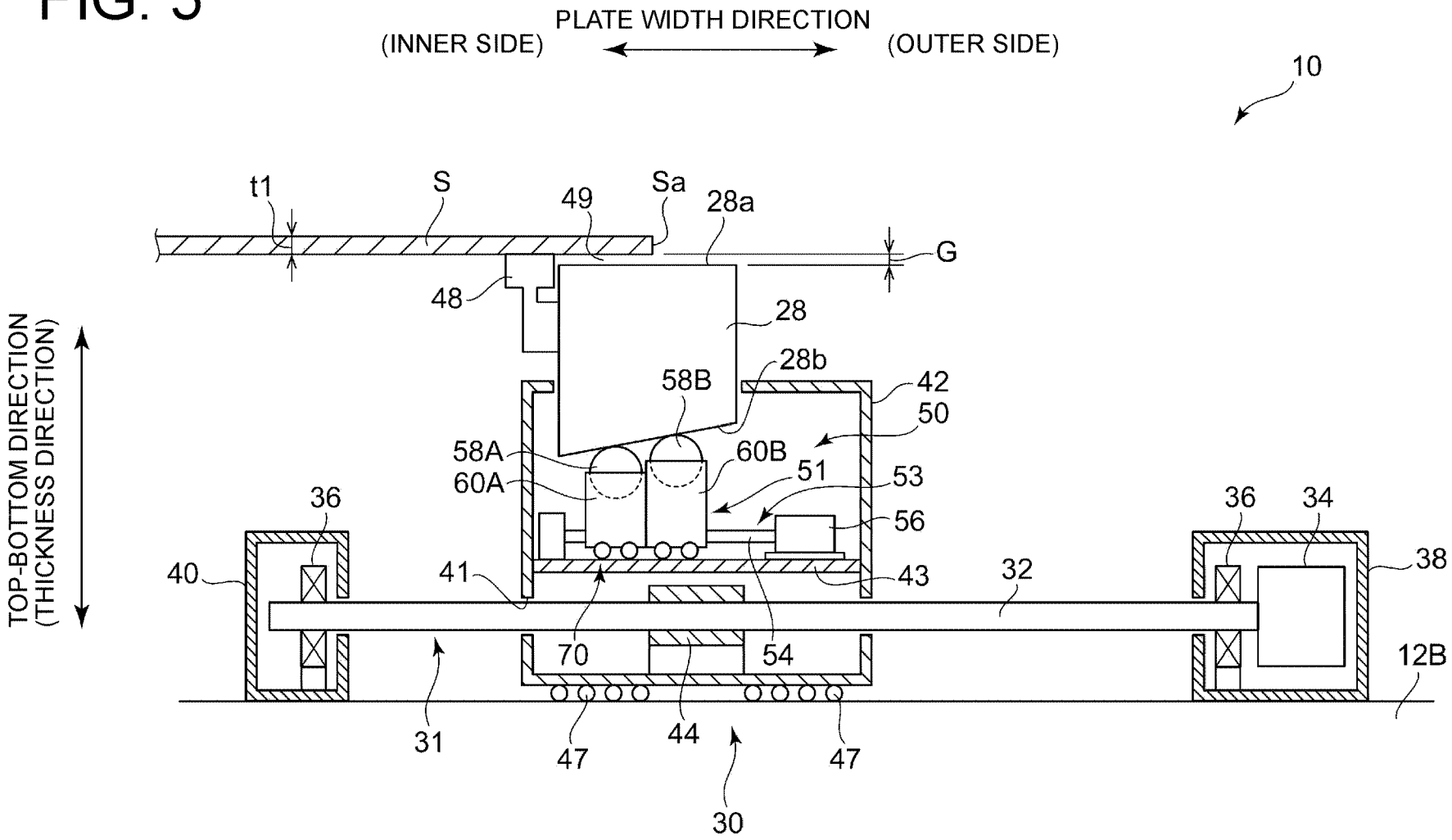
FIG. 5 is an enlarged schematic diagram of a portion including a heating part of a thickness measurement/heating device (rolling mill facility) according to an embodiment.
Figure 6:
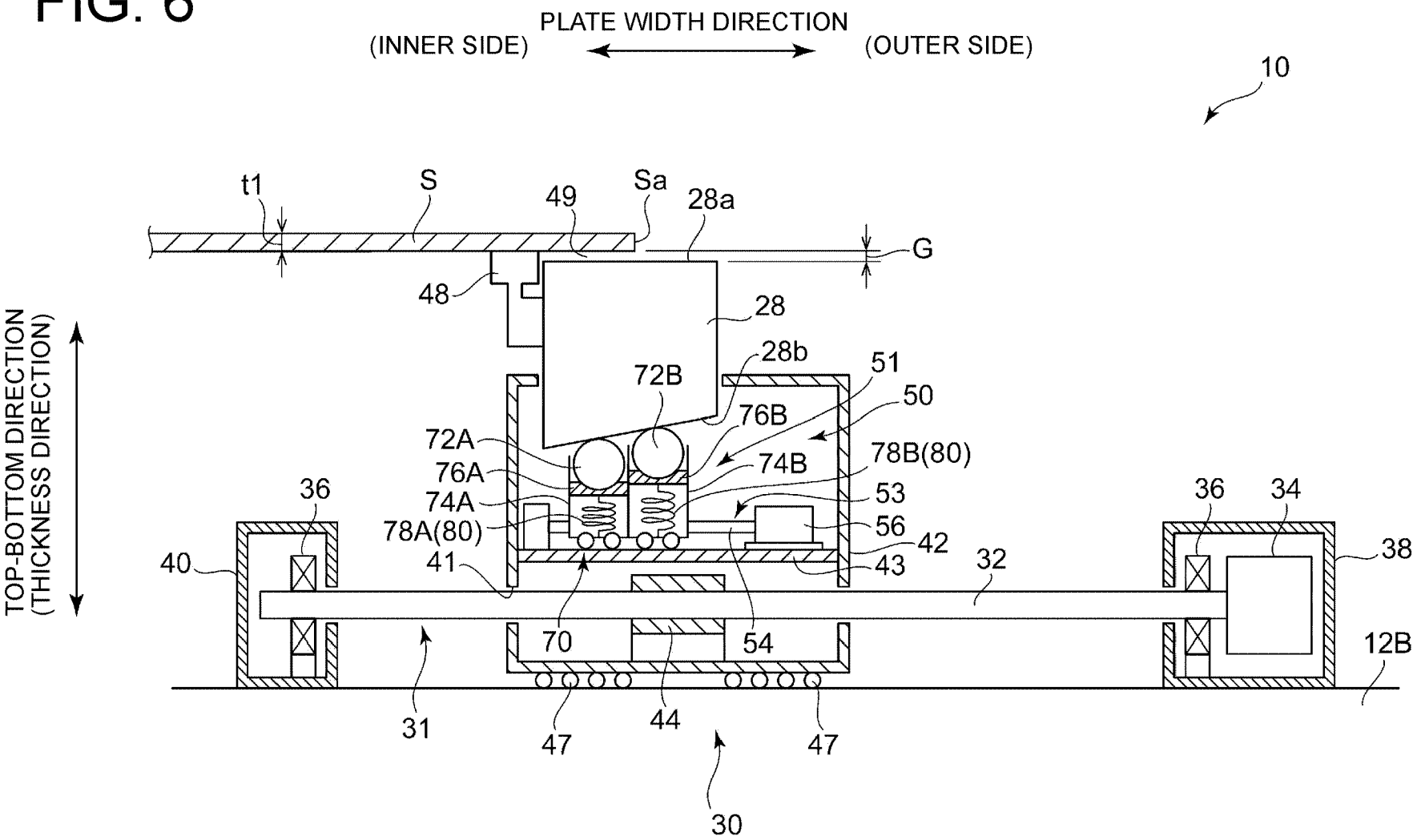
FIG. 6 is an enlarged schematic diagram of a portion including a heating part of a thickness measurement/heating device (rolling mill facility) according to an embodiment.

Herein, FIGS. 4A, 5, 6 are each an enlarged schematic diagram of a portion including the heating part 26 of the thickness measurement/heating device 10 according to an embodiment. FIG. 4B is a diagram for describing the operation of the thickness measurement/heating device 10 depicted in FIG. 4A. In FIGS. 4A to 6, the heating part 26 supported by the lower frame 12B is depicted. Nevertheless, the heating part 26 supported on the upper frame may have the same configuration.

In the illustrative embodiment depicted in FIGS. 4A to 6, the first position adjustment part 30 includes a support box 42 for supporting the heater 28 (heating part 26), a ball screw 31 including a screw shaft 32 and a nut 44, and a motor 34 configured to rotary drive the screw shaft 32.

The screw shaft 32 extends along the plate width direction, and is supported on the lower frame 12B (support part 12) so as to be rotatable via a bearing 36. The motor 34 and the bearing 36 may be housed in a casing 38 fixed to the lower frame 12B (support part 12).

The support box 42 is configured to be movable integrally with the heater 28 along the plate width direction. The support box 42 has a through hole 41 through which the screw shaft 32 is inserted. Furthermore, the support box 42 is configured to be capable of sliding on the surface of the lower frame 12B via a roller 47 (see FIG. 4A) or a guide rail (not depicted), for instance. The nut 44 of the ball screw 31 is fixed to the support box 42.

With the first position adjustment part 30 having the above configuration, when the screw shaft 32 is rotary driven by the motor 34, the nut 44, the support box 42, and the heater 28 (heating part 26) move integrally along the plate width direction (or along the axial direction of the screw shaft 32) relative to the lower frame 12B. At this time, the movement amount (distance) of the nut 44, the support box 42, and the heater 28 in the plate width direction corresponds to the rotation amount of the screw shaft 32. Thus, by adjusting the rotation amount of the screw shaft 32, it is possible to adjust the position of the heater 28 (heating part 26) in the plate width direction.

In the above described embodiment, the heater 28 (heating part 26) is movable along the plate width direction relative to the support part 12, and thus it is possible to move the heater 28 (heating part 26) in the plate width direction in accordance with the change of the position of the plate edge Sa of the steel plate S in a case where, for instance, the plate width of the steel plate S is changed during operation of the rolling mill facility 1. Thus, it is possible to heat the opposite edge portions of the steel plate S more appropriately.

In some embodiments, the heating part 26 is configured to be capable of moving along the plate width direction at an outer side of the thickness measurement part 20 in the plate width direction. In the present specification, the direction oriented from the plate edge Sa toward the center of the steel plate S in the plate width direction is referred to as the inward direction of the plate width direction, and the direction oriented from the center toward the plate edge Sa of the steel plate S in the plate width direction is referred to as the outward direction of the plate width direction.

In the illustrative embodiment depicted in FIGS. 2 and 3, the first position adjustment part 30 including the ball screw 31 is disposed at the outer side of the thickness measurement part 20 in the plate width direction. Thus, the heater (heating part 26) is capable of moving along the plate width direction at the outer side of the thickness measurement part 20 in the plate width direction. As depicted in FIGS. 2 and 3, the first position adjustment part 30 including the ball screw 31 may be disposed at the outer side of the protectors 14, 16 for protecting the thickness measurement part 20 in the plate width direction. That is, the heater (heating part 26) may be configured to be capable of moving along the plate width direction at the outer side of the protectors 14, 16 in the plate width direction.

In the above described embodiment, the heating part 26 is capable of moving along the plate width direction at the outer side, in the plate width direction, of the thickness measurement part 20 or the protectors 14, 16, and thus the heating part 26 does not interfere with the thickness measurement part 20 or the protectors 14, 16 even if the heating part 26 moves in the plate width direction. Thus, it is possible to suppress damage to devices such as the heating part 26, the thickness measurement part 20, and the protectors 14, 16.

As depicted in FIGS. 4A to 6, the thickness measurement/heating device 10 may include a gap forming member 48 for forming a gap 49 between the steel plate S and the heating part 26 in the thickness direction of the steel plate S. In the illustrative embodiment depicted in FIGS. 4A to 6, the gap forming member 48 is disposed so as to protrude from a facing surface 28*a* of the heater 28 (heating part 26) which faces the steel plate S, in the direction toward the steel plate S in the thickness direction of the steel plate S by a predetermined length G.

According to the above configuration, the gap 49 is formed between the steel plate S and the heater 28 (heating part 26) with the gap forming member 48, and thus it is easier to maintain the distance between the steel plate S and the heater 28 (heating part 26) in an appropriate range even in a case where the steel plate S moves up and down during operation of the rolling mill facility 1 or in a case where the thickness of the steel plate S is changed, for instance. Thus, it is possible to heat the steel plate S efficiently regardless of the thickness of the steel plate S. It should be noted that the protrusion amount (the above described length G) of the gap forming member 48 from the facing surface 28*a* is set to a value appropriate for heating the edge portion of the steel plate S in accordance with the type or the like of the heater 28 (heating part).

In some embodiments, the heating part 26 is configured to be capable of moving along the top-bottom direction (or in the thickness direction of the steel plate S) with respect to the support part 12. Alternatively, as depicted in FIGS. 4A to 6 for instance, the thickness measurement/heating device 10 includes the second position adjustment part 50 (position adjustment part) configured to adjust the position of the heating part 26 in the top-bottom direction.

In the illustrative embodiment depicted in FIGS. 4A to 6, the second position adjustment part 50 for adjusting the position of the heater (heating part 26) in the top-down direction includes a ball screw 53 including a screw shaft 54 extending along the horizontal direction and a nut (not depicted) screwed with the screw shaft, a motor 56 configured to rotary drive the screw shaft 54, and a movable part 51 configured to move along the axial direction of the screw shaft 54. In the illustrative embodiment, the screw shaft 54, the motor 56, and the movable part 51 are supported on the support box 42 via a fixed plate 43 fixed to the support box 42. Furthermore, the screw shaft 54 is supported rotatably by bearings (not depicted). The nut of the ball screw 53 is fixed to the movable part 51. The movable part 51 is configured to be capable of sliding on the surface of the fixed plate 43 via a roller 70 (see FIGS. 5, 6) or a guide rail (not depicted), for instance. As the screw shaft 54 is rotary driven by the motor 56, the nut (not depicted) and the movable part 51 move along the axial direction of the screw shaft 54 (that is, along the horizontal direction) relative to the support box.

The heater 28 (heating part 26) is configured to be capable of moving in the top-bottom direction with respect to the support box 42. That is, the heater 28 is movable in the top-bottom direction relative to the lower frame (support part 12). Although not depicted particularly, the support box 42 may have a guide part for guiding the movement of the heater in the top-bottom direction.

The heater 28 has an oblique surface 28*b* that is oblique with respect to the horizontal plane, at an opposite side to the facing surface 28*a* facing the steel plate S in the top-bottom direction.

The movable part 51 is in contact with the oblique surface 28*b* at two or more points at different positions in the top-bottom direction. In the illustrative embodiment depicted in FIGS. 4A and 4B, the movable part 51 includes a movable member 52 having an oblique surface 52*a* corresponding to the oblique surface 28*b* of the heater 28. In the illustrative embodiment depicted in FIG. 5, the movable part 51 includes balls 58A, 58B capable of contacting the oblique surface 28*b* of the heater 28 at points of different positions in the top-bottom direction, and support cylinders 60A, 60B for supporting the balls 58A,58B on the support box 42. In the illustrative embodiment depicted in FIG. 6, the movable part 51 includes balls 72A, 72B capable of contacting with the oblique surface 28*b* of the heater 28 at points of different positions in the top-bottom direction, guide cylinders 74A, 74B and ball seatings 76A, 76B for guiding movement of the balls 72A, 72B along the top-bottom direction, and springs 78A, 78B capable of expanding and contracting in the top-bottom direction and supporting the balls 72A, 72B.

As the movable part 51 moves along the screw shaft 54 (that is, along the horizontal direction), the contact point of the oblique surface 28*b* to the movable part 51 changes, and thereby the heater 28 moves in the top-bottom direction. At this time, the movement amount of the heater 28 in the top-bottom direction corresponds to the movement amount of the movable part 51 along the axial direction of the screw shaft 54, and the movement amount of the movable part 51 corresponds to the rotation amount of the screw shaft 54. Thus, by adjusting the rotation amount of the screw shaft 54, it is possible to adjust the position of the heater 28 (heating part 26) in the top-bottom direction.

Alternatively, in some embodiments, the second position adjustment part 50 may include a hydraulic cylinder or a pneumatic cylinder supported on the support part 12 and configured to expand and contract in the top-bottom direction. The hydraulic cylinder or pneumatic cylinder may be disposed on the fixed plate 43 disposed inside the support box 42, and supported on the support part 12 via the fixed plate 43 and the support box 42.

According to the above configuration, it is possible to adjust the position of the heater 28 (heating part 26) in the top-bottom direction with the second position adjustment part 50, and thus it is possible to change the position of the heater 28 (heating part 26) in accordance with the thickness of the steel plate S in a case where the thickness of the steel plate S is changed, for instance. Thus, it is possible to maintain the distance between the steel plate S and the heater 28 (heating part 26) within an appropriate range. Thus, it is possible to heat the steel plate S efficiently regardless of the thickness of the steel plate S.

Furthermore, in the illustrative embodiment depicted in FIGS. 4A to 6, the gap forming member 48 is supported on the heater 28, and the gap forming member 48 and the heater 28 (heating part 26) are movable integrally. Thus, the second position adjustment part 50 is capable of adjusting the position of the gap forming member 48 in the top-bottom direction.

For instance, FIG. 4A depicts the thickness measurement/heating device 10 during rolling of the steel plate S having a relatively small plate thickness t1. Herein, if the plate thickness of the steel plate S is changed to a greater thickness t1 (t1<t2) (see FIG. 4B), the second position adjustment part 50 is operated appropriately at the time when the plate thickness is changed from t1 to t2, so as to move the position of the heater 28 and the gap forming member 48 in the top-bottom direction downward just by the difference between t2 and t1 (t2−t1). FIG. 4B is a diagram showing the thickness measurement/heating device 10 after the position of the heater 28 and the gap forming member 48 is moved downward accordingly. Thus, according to the above described embodiment, in a case where the plate thickness of the steel plate S is changed, it is possible to maintain the distance between the steel plate S and the heater 28 (heating part 26) easily within an appropriate range. Thus, it is possible to heat the steel plate S efficiently regardless of the thickness of the steel plate S.

In some embodiments, the thickness measurement/heating device 10 includes a shock absorbing part 80 for reducing the force that the gap forming member 48 receives from the steel plate S. For instance, in the illustrative embodiment depicted in FIG. 6, the above described springs 78A, 78B function as the shock absorbing part 80. Alternatively, in a case where a hydraulic cylinder or a pneumatic cylinder is used as the above described second position adjustment part 50, the sealed part of oil or air of the hydraulic cylinder or the pneumatic cylinder functions as the shock absorbing part 80.

According to the above embodiment, the shock absorbing part 80 reduces the force that the gap forming member 48 receives from the steel plate S. Thus, even in a case where a force is applied to the members disposed between the steel plate S and the support part 12 (e.g., the constituent members of the first position adjustment part 30 or the second position adjustment part 50 described above) due to oscillation or the like of the steel plate S, the force acting on the members is less likely to be excessive. Accordingly, it is possible to suppress damage to the equipment.

Hereinafter, a rolling mill facility according to some embodiments will be described briefly.

(1) According to at least one embodiment of the present invention, a rolling mill facility includes: a support part extending along a plate width direction of a steel plate to be rolled; a thickness measurement part supported by the support part and configured to measure a thickness of the steel plate; and a heating part supported by the support part at positions at both sides across the thickness measurement part in the plate width direction and configured to heat both edge portions of the steel plate.

According to the above configuration (1), the thickness measurement part and the heating part are arranged in the plate width direction and supported on the single support part extending along the plate width direction, and thus it is possible to obtain a compact device having both of the thickness measurement function and the plate edge heating function. Thus, it is possible to realize both of the function to measure the thickness of the steel plate and the function to heat the plate edge portions, in a limited space in the vicinity of the rolling mill.

(2) In some embodiments, in the above configuration (1), the heating part is configured to heat the steel plate by induction heating.

According to the above configuration (2), it is possible to heat the steel plate rapidly and efficiently by induction heating. Thus, even with a small heating device, it is possible to appropriately heat the opposite edge portions of the steel plate being conveyed at a high speed.

(3) In some embodiments, in the above configuration (1) or (2), the support part includes: an upper frame disposed above the steel plate and extending along the plate width direction; a lower frame disposed so as to face the upper frame across the steel plate and extending along the plate width direction; and a side frame extending along a top-bottom direction and connecting an end portion of the upper frame and an end portion of the lower frame. The thickness measurement part and the heating part are each supported on at least one of the upper frame or the lower frame.

According to the above configuration (3), it is possible to appropriately support the thickness measurement part and the heating part with a compact support part including the upper frame and the lower frame extending along the plate width direction, and the side frame connecting the upper frame and the lower frame. Thus, it is possible to obtain a compact device including both of the thickness measuring function and the plate edge heating function.

(4) In some embodiments, in the above configuration (3), the thickness measurement part includes: a radiation receiving part supported on one of the upper frame or the lower frame, and; a radiation generation part disposed at an opposite side to the radiation receiving part across the steel plate in a thickness direction of the steel plate and supported on the other one of the upper frame or the lower frame, the radiation generation part being configured to generate radiation which radiates toward the radiation receiving part.

The vicinity of a rolling mill including mill rolls is often a harsh environment where rolling mill oil and fume scatter in large quantity, the mill rolls vibrate, and it is dark, for instance. In this regard, according to the above configuration (4), the thickness measurement part includes the radiation generation part and the radiation receiving part and uses radiation, which makes it possible to appropriately measure the thickness of the steel plate in the vicinity of the rolling mill under a harsh environment.

(5) In some embodiments, in the above configuration (3) or (4), the heating part includes a heater supported on the upper frame.

According to the above configuration (5), the heating part is supported on the upper frame, and thus it is possible to provide the heating part so as not to interfere with a member (e.g., pipe) arranged below the steel plate.

(6) In some embodiments, in any one of the above configurations (3) to (5), the heating part includes a heater disposed at an opposite side to the side frame across the thickness measurement part in the plate width direction and supported on the lower frame.

If, hypothetically, the heating part is provided and supported on the upper frame in a region opposite to the side frame across the thickness measurement part in the plate width direction, the distance from the side frame to the heating part extends, and the tip load of the upper frame increases. Thus, it is necessary to increase the strength of the support part by increasing the size of the support part, for instance. In this regard, according to the above configuration (6), the heater disposed at an opposite side to the side frame across the thickness measurement part in the plate width direction is supported on the lower frame, and thus the tip load of the upper frame does not increase. Thus, it is less necessary to increase the strength of the support part, which makes it possible to obtain a more compact device.

(7) In some embodiments, in any one of the above configurations (1) to (6), the heating part is configured to be movable along the plate width direction with respect to the support part.

According to the above configuration (7), the heating part is capable of moving along the plate width direction relative to the support part, and thus it is possible to change the position of the heating part in accordance with the change of the position of the plate edge of the steel plate in a case where, for instance, the plate width of the steel plate is changed. Thus, it is possible to heat the opposite edge portions of the steel plate more appropriately.

(8) In some embodiments, in the above configuration (7), the heating part is configured to move along the plate width direction at an outer side of the thickness measurement part in the plate width direction.

According to the above configuration (8), the heating part is capable of moving along the plate width direction at the outer side, in the plate width direction, of the thickness measurement part, and thus the heating part does not interfere with the thickness measurement part even if the heating part moves. Thus, it is possible to suppress damage to devices such as the heating part and the thickness measurement part.

(9) In some embodiments, in any one of the above configurations (1) to (8), the rolling mill facility includes a gap forming member for forming a gap between the steel plate and the heating part in a thickness direction of the steel plate.

According to the above configuration (9), a gap is formed between the steel plate and the heating part with the gap forming member, and thus it is easier to maintain the distance between the steel plate and the heating part in an appropriate range. Thus, it is possible to heat the steel plate efficiently regardless of the thickness of the steel plate.

(10) In some embodiments, in the above configuration (9), the gap forming member is disposed so as to protrude, in a direction toward the steel plate in the thickness direction of the steel plate, from a facing surface of the heating part which faces the steel plate.

According to the above configuration (10), the gap forming member is disposed so as to protrude toward the steel plate from the facing surface of the heating part, and thus it is possible to form a gap between the steel plate and the heating part appropriately with the gap forming member. Thus, it is possible to heat the steel plate efficiently regardless of the thickness of the steel plate.

(11) In some embodiments, in the above configuration (9) or (10), the rolling mill facility includes a shock absorbing part for reducing a force which the gap forming member receives from the steel plate.

According to the above configuration (11), the shock absorbing part reduces the force that the gap forming member receives from the steel plate. Thus, even in a case where a force is applied to the member disposed between the steel plate and the support part due to oscillation or the like of the steel plate, the force applied to the member is less likely to be excessive. Accordingly, it is possible to suppress damage to the equipment.

(12) In some embodiments, in any one of the above configurations (1) to (11), the rolling mill facility includes a position adjustment part configured to adjust a position of the heating part in a top-bottom direction.

According to the above configuration (12), it is possible to adjust the position of the heating part in the top-bottom direction, and it is possible to maintain the distance between the steel plate and the heating part within an appropriate range by changing the position of the heating part in accordance with the thickness of the steel plate in a case where the thickness of the steel plate is changed, for instance. Thus, it is possible to heat the steel plate efficiently regardless of the thickness of the steel plate.

(13) In some embodiments, in any one of the above configurations (1) to (12), the rolling mill facility includes a mill roll for rolling the steel plate, positioned at a downstream side of the thickness measurement part and the heating part in a conveyance direction of the steel plate.

According to the above configuration (13), the thickness measurement part and the heating part are arranged in the plate width direction and supported on a single support part extending along the plate width direction, and thus it is possible to obtain a compact device having both of the thickness measurement function and the plate edge heating function. Thus, it is possible to realize both of the function to measure the thickness of the steel plate and the function to heat the plate edge portions, in a limited space in the vicinity of the rolling mill.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

REFERENCE SIGNS LIST

1 Rolling mill facility
2 Rolling mill
3, 3A to 3D Rolling mill stand
4 Mill roll
6 Conveyance roll
7 Deflector roll
8 Rewinder
10 Heating device
12 Support part
12A Upper frame
12Aa End portion
12B Lower frame
12Ba End portion
12C Side frame
14 Protector
16 Protector
18 Gas injection pipe
20 Thickness measurement part
22 Radiation generation part
24 Radiation receiving part
26 Heating part
28 Heater
28A First heater
28B Second heater
28*a* Facing surface
28*b* Oblique surface
30 First position adjustment part
31 Ball screw
32 Screw shaft
34 Motor
36 Bearing
38 Casing
41 Through hole
42 Support box
43 Fixed plate
44 Nut
47 Roller
48 Gap forming member
49 Gap
50 Second position adjustment part
51 Movable part
52 Movable member
52*a* Oblique surface
53 Ball screw
54 Screw shaft
56 Motor
58A Ball
58B Ball
60A Support cylinder
60B Support cylinder
70 Roller
72A Ball
72B Ball
74A Guide cylinder
74B Guide cylinder
76A Ball seating
76B Ball seating
78A Spring
78B Spring
80 Shock absorbing part
101 Radiation
C Center position
S Steel plate
Sa Plate edge

The invention claimed is:

1. A rolling mill facility, comprising:
a thickness measurement and heating device including:
a support part extending along a plate width direction of a steel plate to be rolled;
a thickness measuring device supported by the support part and configured to measure a thickness of the steel plate; and
heaters respectively supported by the support part at positions at both sides across the thickness measuring device in the plate width direction and configured to heat both edge portions of the steel plate; and
a mill roll for rolling the steel plate, positioned at a downstream side of the thickness measurement and heating device in a conveyance direction of the steel plate.

2. The rolling mill facility according to claim 1,
wherein the heaters are configured to heat the steel plate by induction heating.

3. The rolling mill facility according to claim 1,
wherein the support part includes:
an upper frame disposed above the steel plate and extending along the plate width direction;
a lower frame disposed so as to face the upper frame across the steel plate and extending along the plate width direction; and
a side frame extending along a top-bottom direction and connecting an end portion of the upper frame and an end portion of the lower frame, and
wherein the thickness measuring device and the heaters are each supported on at least one of the upper frame or the lower frame.

4. The rolling mill facility according to claim 3,
wherein the thickness measuring device includes:

a radiation receiving part supported on one of the upper frame or the lower frame, and;

a radiation generator disposed at an opposite side to the radiation receiving part across the steel plate in a thickness direction of the steel plate and supported on the other one of the upper frame or the lower frame, the radiation generator being configured to generate radiation which radiates toward the radiation receiving part.

5. The rolling mill facility according to claim 3, wherein the heaters include a heater supported on the upper frame.

6. The rolling mill facility according to claim 3, wherein the heaters include a heater disposed at an opposite side to the side frame across the thickness measuring device in the plate width direction and supported on the lower frame.

7. The rolling mill facility according to claim 1, wherein at least one of the heaters is configured to be movable along the plate width direction with respect to the support part.

8. The rolling mill facility according to claim 7, wherein the at least one of the heaters is configured to move along the plate width direction at an outer side of the thickness measuring device in the plate width direction.

9. The rolling mill facility according to claim 1, wherein the thickness measurement and heating device further includes, a gap former for forming a gap between the steel plate and at least one of the heaters in a thickness direction of the steel plate.

10. The rolling mill facility according to claim 9, wherein the gap former is disposed so as to protrude, in a direction toward the steel plate in the thickness direction of the steel plate, from a facing surface of the at least one of the heaters which faces the steel plate.

11. The rolling mill facility according to claim 9, wherein the thickness measurement and heating device further includes, a shock absorber for reducing a force which the gap former receives from the steel plate.

12. The rolling mill facility according to claim 1, wherein the thickness measurement and heating device further includes, a position adjuster configured to adjust a position of at least one of the heaters in a top-bottom direction.

* * * * *